United States Patent [19]

Schweder

[11] Patent Number: 5,015,299

[45] Date of Patent: May 14, 1991

[54] METHOD AND APPARATUS FOR THE REMOVAL OF DEPOSITS FROM THE INNER SURFACES OF HORIZONTAL CYLINDERS

[75] Inventor: Herbert Schweder, Magdeburg, German Democratic Rep.

[73] Assignee: VEB Spezialbaukombinat Magdeburg, Magdeburg, Fed. Rep. of Germany

[21] Appl. No.: 340,239

[22] Filed: Apr. 19, 1989

[30] Foreign Application Priority Data

May 19, 1988 [DD] German Democratic Rep. ... 315913

[51] Int. Cl.[5] ..... B08B 1/00; B08B 9/08

[52] U.S. Cl. ..... 134/8; 15/104.05; 15/236.05; 15/256.5; 51/164.5; 241/184

[58] Field of Search ..... 15/256.5, 104.061, 104.05, 15/104.07, 104.16, 236.05; 241/184; 51/164.5; 134/6, 8; 366/221

[56] References Cited

U.S. PATENT DOCUMENTS

| | | | |
|---|---|---|---|
| 710,798 | 10/1902 | Nowotny | 15/104.061 |
| 864,544 | 8/1907 | Kessler et al. | 15/104.061 |
| 4,736,547 | 4/1988 | Bond et al. | 241/184 |

*Primary Examiner*—Edward L. Roberts
*Attorney, Agent, or Firm*—Schweitzer Cornman & Gross

[57] ABSTRACT

Process and apparatus are provided for the removal of a deposit from the inner surface of a rotating cylinder having a horizontal or inclined longitudinal axis, which comprises introducing a body having a substantially symmetrical concavo-convex silhouette into the cylinder, the body being slidable in the axial direction in the cylinder either by the rotational movement of the cylinder or by means for axial propulsion of the slidable body within the cylinder, the surface of the body being in frictional engagement with the interior surface of the cylinder, the body being adapted to ride up to a point on the wall of the cylinder due to the frictional engagement, and then when the effect of the weight the body becomes greater than the frictional force of the engagement the body slides back in a generally radial direction toward the bottom of the cylinder while wearing away at least a part of the deposit within the cylinder by scraping action of the surface of the said sliding body against the interior wall of the cylinder. The surface of the body in contact with the interior of the cylinder is provided with scraper projections for intensifying the scraping action of the surface of the body against the interior of the rotating cylinder. The apparatus has a horizontal or inclined longitudinal axis, and is a slidable body the cross-sectional shape of which is that of a substantially symmetrical concavo-convex silhouette having an outer side adapted substantially to mate with and to slide upon the interior surface of the cylinder, an inner side, and two end faces, one or both of the end faces being adapted to have a swivel attached thereto.

14 Claims, 7 Drawing Sheets

METHOD AND APPARATUS FOR THE REMOVAL OF DEPOSITS FROM THE INNER SURFACES OF HORIZONTAL CYLINDERS

FIELD OF THE INVENTION

The invention relates to a method for the removal of deposits from the inner surfaces of horizontal, rotating tubular cylinders, such as rotary kilns, and to apparatus for carrying out the method.

BACKGROUND OF THE INVENTION

In German Democratic Republic Pat. No. 238,102 German Democratic Republic patent application No. WP F 27 D/315 174-7, and U.S. Pat. No. 4,775,315, machines are presented for breaking out deposits and the lining of rotary kilns. The two machines are characterized in that, while the tubular cylinder of the rotary kiln rotates about its own center line, the breaking out of deposit and lining takes place together or separately by means of a pounding, wedging or breaking action. These known technical solutions are particularly suitable for applications, in which solid and stressed linings and deposits of appropriate thickness in rotary kilns are broken out by the selective destruction of their arched structures. When used for thin, soft or tough layers of deposits of the incrustation, and also when very loose material is to be removed, the method and the associated apparatus, cannot guarantee an economic mode of operation, because of their pounding, coarse, wedging mode of operation. The result, aimed at the pounding action, shows an intensive, point-like stress on the cylinder jacket or the elements of the apparatus, since the material that is to be worked on is soft, or tough, and offers a latent resistance to the impacting action of the apparatus. It is also disadvantageous that the construction and equipment costs are very large to build the apparatus with a pounding action.

U.S. Pat. No. 3,245,154 discloses an apparatus for distributing solid, flowable, adhesive or sludge-like materials in a rotary drying kiln during the drying process to avoid caking. This apparatus achieves its effect by a rolling friction on the inner wall of the drum. This apparatus consists of three parts. On the one hand, it consists of two different sectors, the external diameters of which are equal to the internal diameter of the drum. They are fastened in the drum and have no sliding contact lines with the drum. The third sector of the apparatus, as does the second sector, consists of lifing bars, the outer edges of which are directed radially towards the inside of the drum. This third sector has an external diameter, which is smaller than the internal diameter of the drum and moves radially rolling and axially guided in the drum. As the drum rotates, this third sector is moved into a suspended position. As it rolls back from this position, it produces with the outer edges of its lifting bars contact lines on the inside of the drum.

The material, sliding into the drum over a discharge hopper, passes through the apparatus, starting with the third sector. Only the outer edges of the lifting bars of this sector, which takes up the material, rub on the inside of the drum. The only function of the lifting bars with their tongues and with the furthermore provided feeding bars in the second and in the first sector is to transport the material.

The object of the U.S. patent and the means of accomplishing this object are as follows: to keep an amorphous material uniformly distributed and mobile as it passes through a drum during a drying cycle. With the disclosed apparatus, which was described above, the material is lifted from the wall of the drum and held loose and guided to the outlet of the drum by means of parts of the apparatus.

U.S. Pat. No. 3,333,837 discloses a drum, which rotates about a generally horizontal axis and in which there is disposed a cage, which can be rotated parallel to the axis of rotation. The roll diameter of the cage is less than the internal diameter of the drum and its length is congruent with that of the drum. The cage consists of an open frame, which has radially directed working elements, which are distributed uniformly over its periphery and form sliding contact lines on the inside of the drum. The working elements are formed in a further development of the apparatus.

In the cage, chains are suspended, with are connected with the working elements. The rotation of the drum moves the apparatus into a suspended position, from which it returns with a rolling motion or in which it can also stay with a rolling motion. During the rolling process, the outer edges of the working elements rub on the drum and lift introduced material up from there and then transport this detached material onward.

The object and the mode of action of the solution of the patent are similar to the solution set forth in U.S. Pat. No. 3,245,154 for the applicable third section. The solution of this patent shows a one-piece apparatus with working elements, which are constructed as a cage on its body, are aligned essentially radially, rub by a rolling action in the drum and avoid caking from the very start. The rubbing and scratching action of the working elements on the inside of the drum is intensified further, if the working elements, disposed on the cage, have a helical shape. No provisions are made for an axial motion of the cage in the drum.

U.S. Pat. No. 3,607,399 discloses a method and an apparatus for detaching and removing felted matter and collections of fiber materials from the inner wall of drums, in which these fiber materials are to be dried. The fiber material is blown with a current of carrier air into the rotary drier and moved about and dried in this drier.

At least two rolling working elements are provided in the drum to prevent accumulations generally by felting of the fiber material. These working elements are constructed as rollers and extend the whole length of the inside of the drum. One of the rollers, the heavier one, has a driving function with respect to the second roller, which has a cleaning function, and is situated immediately in front of the second one with respect to the direction of rotation of the drum. THe driving roller has a frictional rubber surface. The surface of the second roller, the actual cleaning roller, has cleaning elements, which simultaneously adhere to the surface of the driving roller and of the inner wall of the drum. The static friction between the rollers is intensified further owing to the fact that the cleaning roller, due to its disposition behind the driving roller with respect to the direction of rotation of the drum, is constantly forced by this driving roller into a suspended position. The cleaning roller has a larger external diameter than the driving roller and therefore a faster circumferential velocity. It works on the inner wall of the drum with a scratching and rubbing action. Due to the arrangement of the driving and cleaning rollers, the rubbing action is restricted to material, which adheres during one revolution. Firmly adhering, compact material cannot be removed.

DESCRIPTION OF THE INVENTION

It is an object of the invention to provide a method for the removal of deposits at the inner surface of horizontal, rotating, tubular cylinders and an apparatus for implementing the method, which enables, in a costs-saving manner and without risk to the health of the workers, working off the deposits, gently, layer by layer and continuously, the apparatus having working elements, which enables a two-dimensional working off procedure.

Pursuant to the invention, this objective is accomplished due to the fact that the sliding body, adhering with its outer surface during the rotational motion of the tubular cylinder on the deposits or the inner surface of the tubular cylinder due to a frictional connection, is moved into a position that is elevated from the bottom position. After exceeding the limiting value of adhesion, the sliding body slides back against the rotational movement of the tubular cylinder into the bottom position. In so doing, it positions itself axially. While the sliding body is sliding back, the working elements wear the deposits away completely and layer by layer by a scraping and rubbing action.

It is within the meaning of the invention that the cross-sectional outline of the sliding body has the shape of a substantially symmetrical concavo-convex silhouette. The larger of the cross sectional radii of the silhouette is adapted to match the internal radius of the tubular cylinder, the sliding body having operative elements, which are constructed to follow its outline.

It is a refinement of the invention that the sliding body has a central part, on which the elements are disposed. In the exercise of the invention, the central part is elongated and rotationally symmetrical.

In an embodiment of the invention, the outline figure of the central part is constructed in the shape of a concavo-convex silhouette and the elements are disposed on the surface of this central part. The invention is developed in that the elements protrude over the central part significantly and are constructed disk-like as well as in the shape of a concave-convex silhouette, the elements being disposed at an obtuse angle to the longitudinal axis of the sliding body. The invention is also developed meaningfully, if the operative elements are disposed at an angle of 90′ to the longitudinal axis of the sliding body.

It is within the further meaning of the invention to provide the surface of the central part with brushes, wipers and scrapers or to dispose the elements in a similar development spirally on the central part. In one embodiment, the elements are disposed interchangeably or, advantageously, also adjustably.

Advantageously, the technical parameters of the apparatus as well as of the steps of the method are coordinated with the processing of thin-layered, loose, as well as soft to plastic caked-on material. The mass and size of the apparatus can be adapted without difficulty to the required intensity and the characteristic application, even while the production is running.

The apparatus has a characteristic feature, in that the internal radius of the tubular cylinder is determinative for the silhouette contour-forming size of the larger of the two radii of the concavo-convex shape. The radius of the introduced apparatus borders on the inside of the tubular cylinder. The rotary motion of the tubular cylinder is converted into a targeted sliding motion of the apparatus. This advantageous sliding motion, generally a sliding and slipping, advantageously produces at the edges of the operative elements tearing, peeling and rubbing forces, which can be utilized for working off deposits and caked-on material.

It is possible to assign a rope pull at the both ends of the apparatus and thus to make possible a forced movement in both directions. The rope pull in both directions is necessary when the apparatus is equipped with brushes, wipers and scrapers, or the elements are disposed at right angles to the longitudinal axis of the central bearing part. In this case, no component of motion is produced along the longitudinal axis of the tubular cylinder, as it is in the case of elements disposed obliquely to the longitudinal axis of the central bearing part.

DESCRIPTION OF THE DRAWING

The invention is described in greater detail below by means of the associated drawing, wherein.

DESCRIPTION OF PREFERRED EMBODIMENTS

Figure 1:
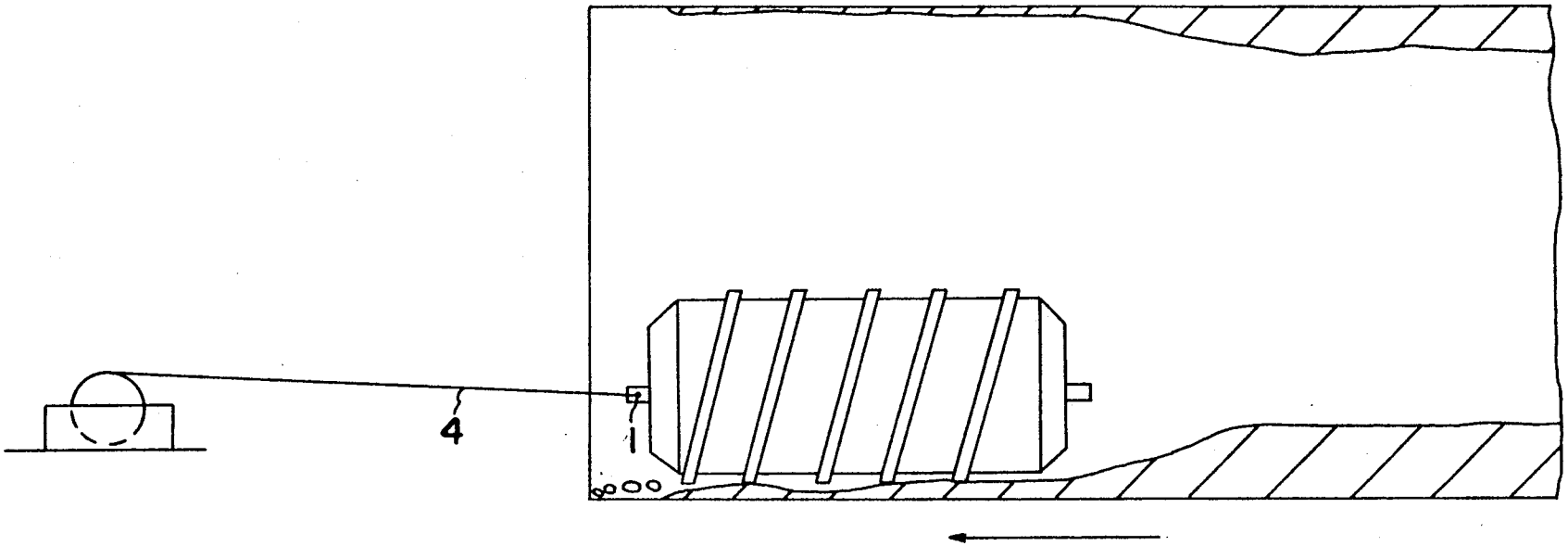
FIG. 1 shows the apparatus in a rotary tubular cylinder.
Figure 2:
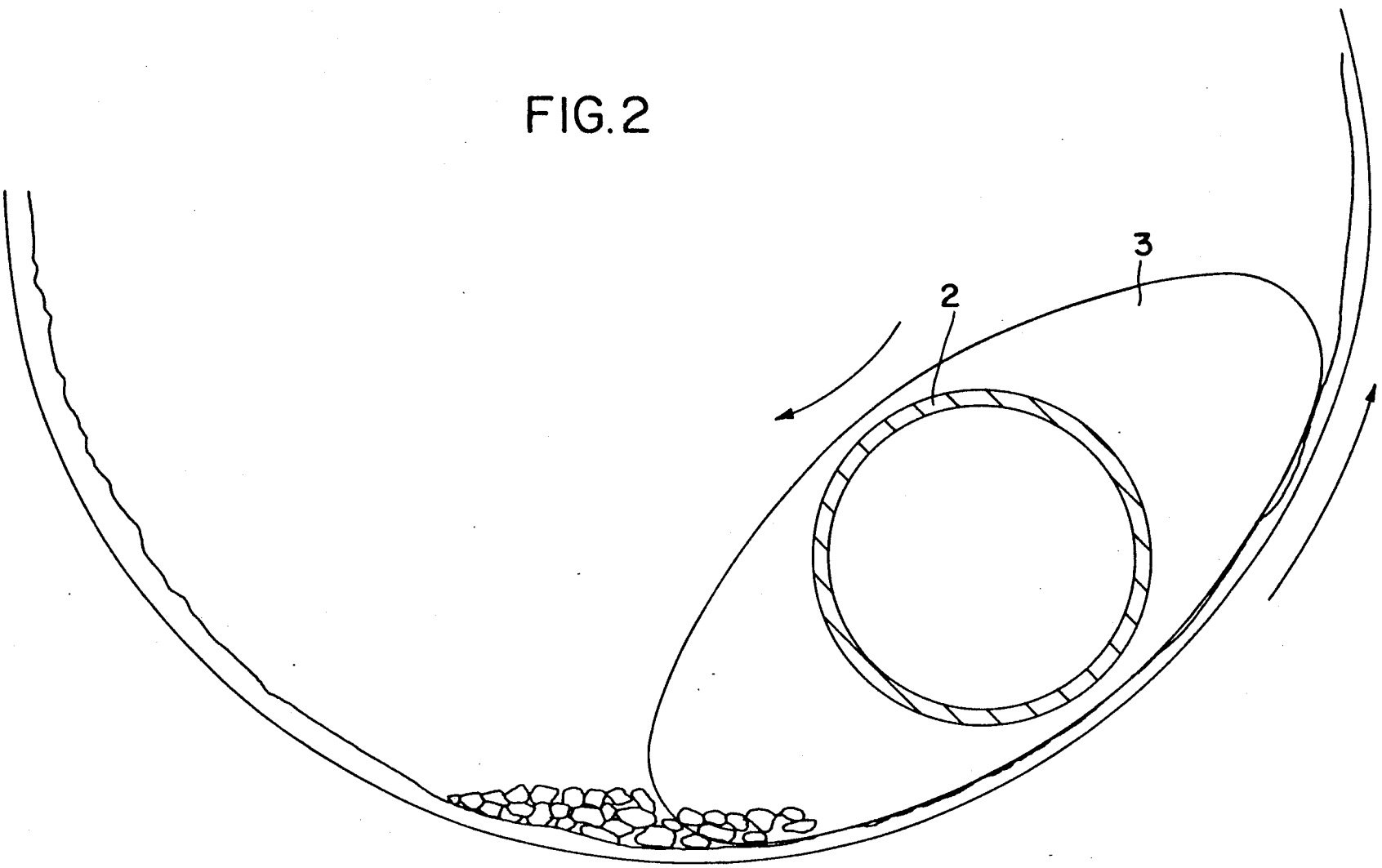
FIG. 2 shows a working phase of a braced sliding body in section.

FIGS. 1 and 2 show a part of a horizontal, rotary-driven tubular cylinder of desired length and diameter, having material caked onto its interior surface. The inner surfaces of this part are adapted to be worked on by sliding bodies of different shapes utilizing the existing driving mechanism of the cylinder.

A uniform characteristic of all embodiments of the apparatus of the present invention that it has a body with an outline, which is adapted to match the internal radius of a respective tubular cylinder and at least one of the cross sectional sides of which is so constructed that the apparatus, when used in a rotating tubular cylinder, cannot automatically be set in rolling motion about its own axis. Instead, the apparatus is caused to move in a special sliding motion counter to the rotary motion of the tubular cylinder. In all versions, the apparatus, lying against the inner wall, is moved by friction to an elevated position and, after exceeding the contact adherence, slides from there into the bottom of the tubular cylinder. In practical applications, this results in typical tearing, peeling and rubbing forces between the apparatus and the inner surface of an associated tubular cylinder, which can be employed to work off deposits, baked-on material and the like.

Figure 3:
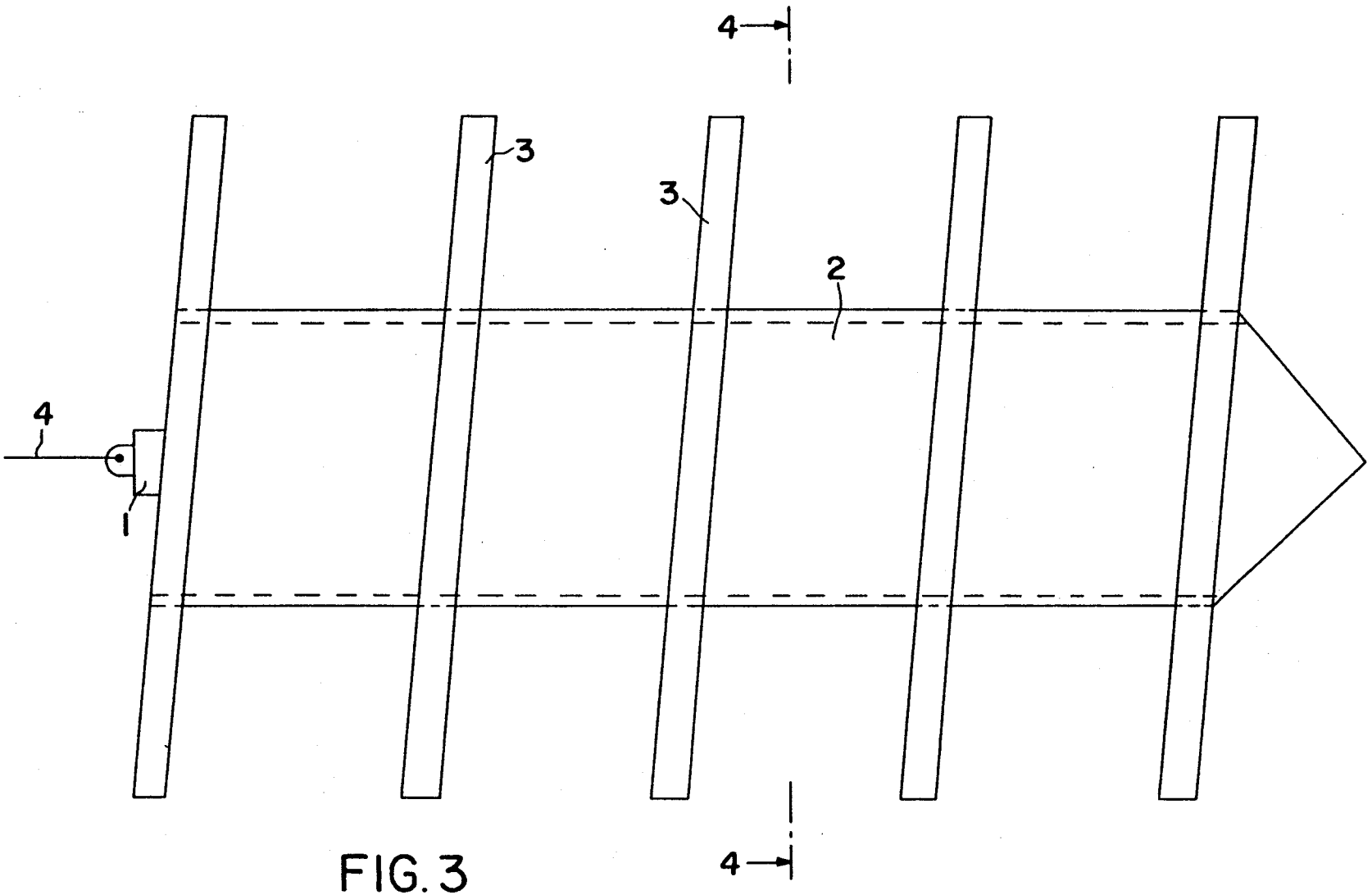
FIG. 3 shows a plan view of a braced sliding body.
Figure 4:
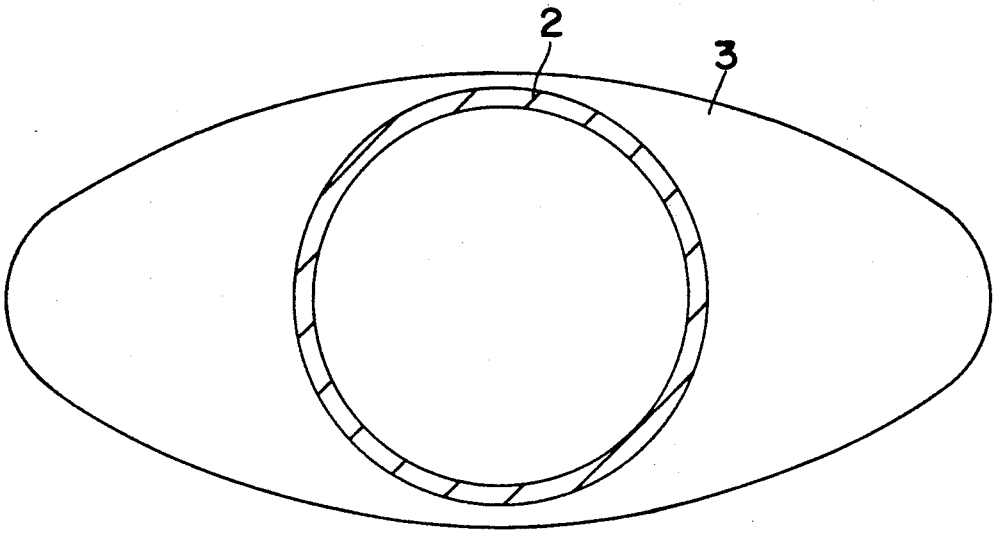
FIG. 4 is a cross sectional view taken along the line A—A of FIG. 3.
Figure 7:
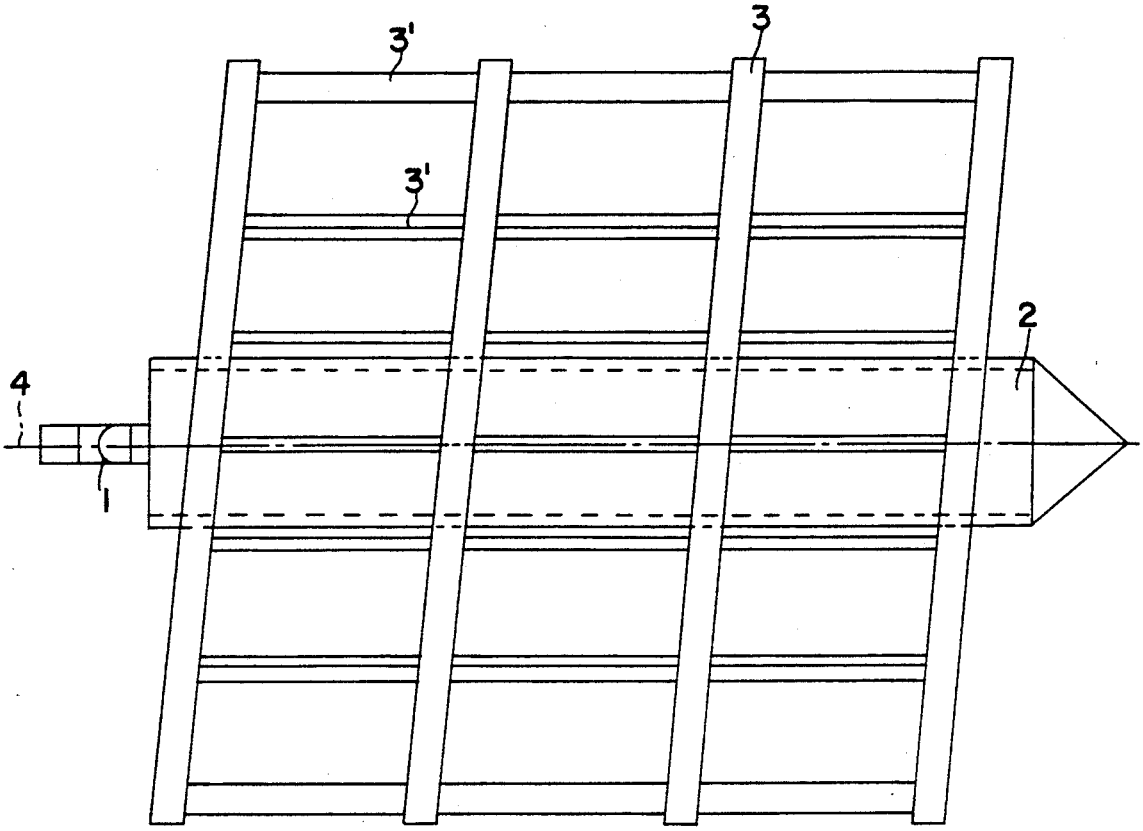
FIG. 7 shows a plan view of a braced sliding body with longitudinally and transversely directed working elements.
Figure 8:
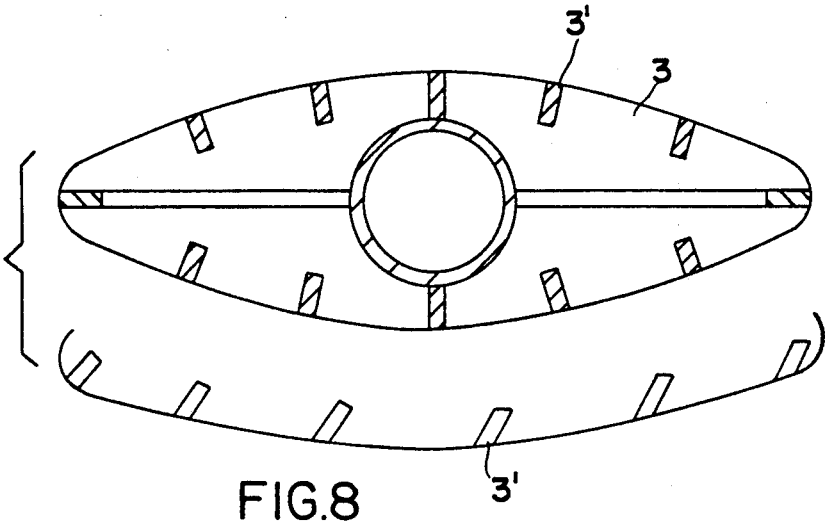
FIG. 8 is a transverse cross sectional view of FIG. 7.
Figure 9:
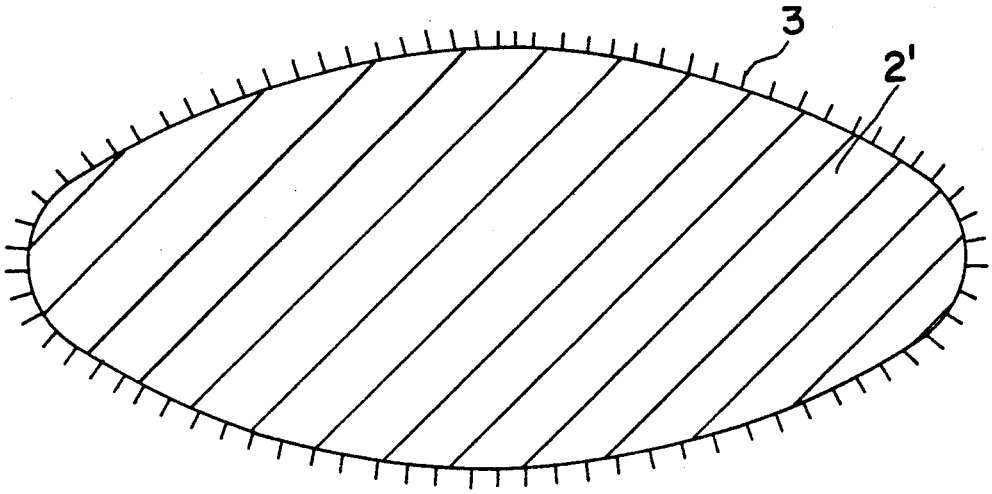
FIG. 9 shows a solid sliding body with brush-like working elements in cross section.
Figure 10:
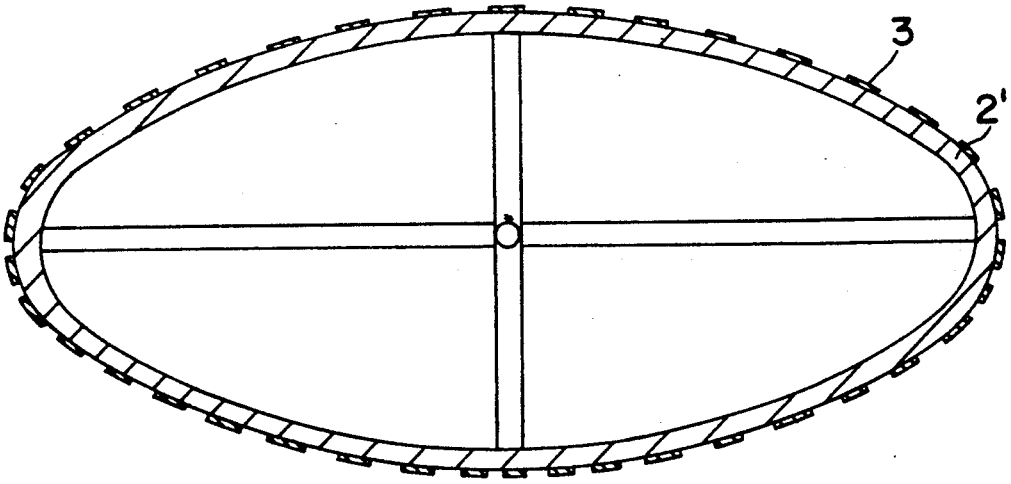
FIG. 10 shows a hollow body with scale-like working elements in cross section.

The sliding body movable within the rotary cylinder is designed depending on the particular application, the rotary kiln dimensions, the nature of the deposit, and the specific use and installation conditions. In the drawing open, braced sliding bodies are shown in FIGS. 3 and 7 and the associated cross sections are shown in FIGS. 4 and 8. A second variation are the solid bodies such as shown in corresponding FIG. 6 with cross sections such as those of FIGS. 5 and 9. According to a third variation, as in FIG. 10, the body has a closed external shape, which may, however, have a hollow interior.

FIRST EXAMPLE

The Braced Sliding Body of FIGS. 3 and 7 (4 and 8)

An elongated body has at least one continuous central bearing part 2;2'. Working elements 3; 3'; 3", which in their outline figure form the outer cross section, are mounted on the central bearing part 2; 2'. The cross sections of FIGS. 4 and 8 are formed as a substantially concavo-convex silhouette shape, the larger of the radii being adapted to match the internal radius of the tubular cylinder. The two cross sectional radii of the concavo-convex silhouette clearly differ from one another in size.

If desired, instead of a slant, the disks of the elements 3 which extend beyond the central part 2, can be mounted at right angles to the longitudinal axis of the body (not shown). In the embodiment as shown in FIGS. 3 and 7, the disks are mounted at an obtuse angle to the longitudinal axis of the body. In such an obtuse angle arrangement, the distance between the elements 3 should be selected so that, with revolving motions in the rotating tubular cylinder, a mode of action is provided, which covers the surface over the length of the body. Depending on the shape and nature of the substrate or of the deposit, the apparatus can be controlled from both ends or from one end only with a rope 4.

A one-sided rope swivel 1 is of decisive importance when the circumstances permit only one swivel 1 and is possible only when the disks of the elements 3; 3" are disposed at such a specific obtuse angle to the longitudinal axis of the body, that it is possible to provide the sliding body with a longitudinally directed component of motion as the tubular cylinder rotates.

For this purpose, it is necessary that the material baked onto the inner surface of the tubular cylinder be of a nature, which enables the formation of stable tracks and, also has a strength which results in a partial diversion of the sliding motion of the body into a desired longitudinal motion component. Thus, the body, guided only at the swivel 1, attaches to desired areas in the rotating tubular cylinder and carries out removal or cleaning work there.

For this purpose the disks of the element 3; 3" at their periphery are suitably provided with assisting tool-like edges. It is an essential characteristic in the design of operative body that its have a shape, which does not damage the actual lining of the rotary cylinder. For that reason, the outline of the body, when viewed in the plane of the disk, is unbroken as far as possible and outer parts 3', which lie transversely to it, do not protrude beyond the outline of the disk of FIG. 7.

SECOND EXAMPLE

A HOMOGENEOUS SLIDING BODY

Figure 5:
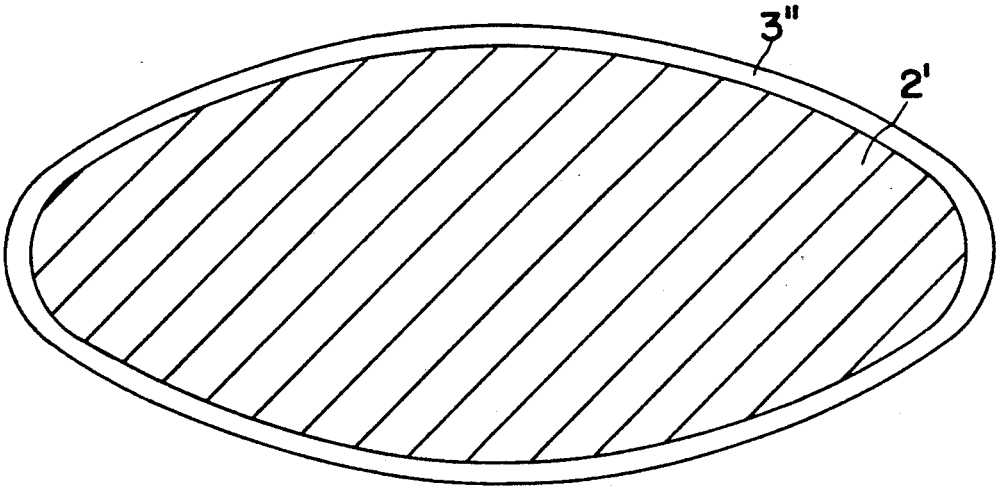
FIG. 5 is a cross sectional view taken along the line B—B of FIG. 6.
Figure 6:
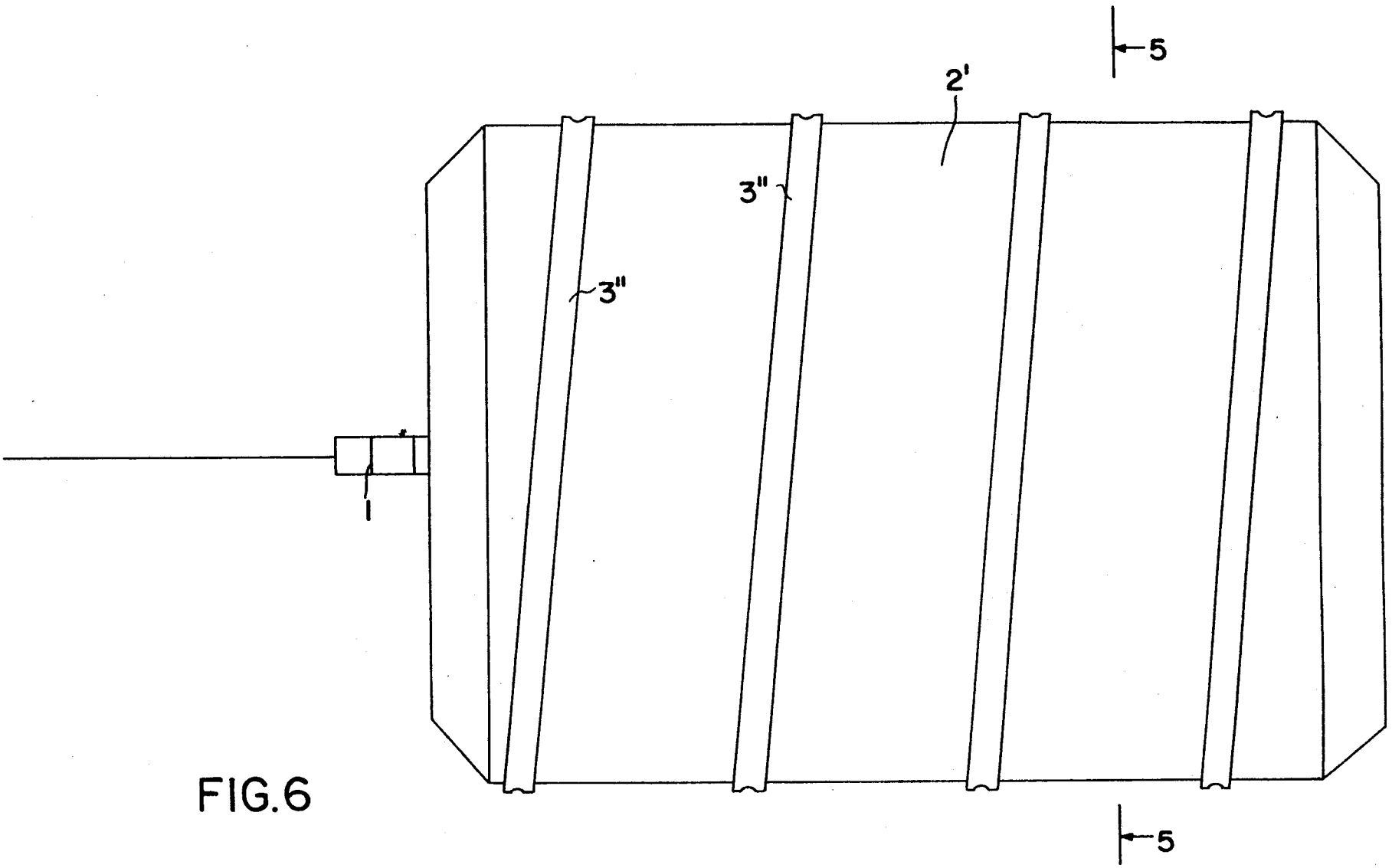
FIG. 6 shows a plan view of a solid sliding body.

In the outline of its cross section, the bearing part 2' of FIGS. 5 and 6 is also similar to a substantially symmetrical concavo-convex silhouette, the larger of the radii being adapted to match the internal radius of the tubular cylinder. The two cross sectional radii clearly differ in size. Operative regions in the form of elements 3", mounted or embedded if required, also correspond in their outer contour to this geometric shape. In the arrangement of the elements 3", it is also possible to select those arrangements which are distributed at right- or obtuse-angles, helically, or two-dimensionally. In the special case of the specific obtuse angular orientation, longitudinally directed movement components can be started as in Example 1.

The surface is designed according to the particular technical requirements. The surface can be smooth or rough or slightly or distinctly profiled. In the special case, as in FIGS. 9 and 10, the working elements are brushes 31 such as of a plastic material or of steel wire, or the like. Alternatively, the working elements can be made in the form of elastic lips, such as wipers 32, suitably of rubber. These special tool-edges then have a cleaning action and can form bare inner surfaces.

THIRD EXAMPLE

HOLLOW SLIDING BODY

The outer cross sectional figure is constructed according to the characteristics of the examples of the operation as in FIGS. 2, 4, 8, 9, 10. The inner space is reinforced but hollow. In the specific example, the outer, bearing body 2' can be maintained elastic. As desired, the surface can be equipped with peripheral working elements.

I claim:

1. A process for the removal of a deposit from the inner surface of a rotating cylinder having a horizontal or inclined longitudinal axis, which comprises introducing a scraping body into the cylinder, said body being slidable forward and back in the axial direction in the cylinder either by the rotational movement of the cylinder or by means for axial propulsion of said slidable body within the cylinder, the surface of said body being in frictional engagement with the interior surface of the cylinder and for selectively scraping away said deposit, said body riding up to a point on the wall of the cylinder due to the frictional engagement, and then when the effect of the weight said body becomes greater than the frictional force of the engagement said body slides back in a generally radial direction toward the bottom of the cylinder while wearing away at least a part of said deposit within said cylinder by scraping action of the surface of said sliding body against the interior wall of the cylinder.

2. The process of claim 1, wherein a single body is employed, and wherein the surface of the body in contact with the interior of the cylinder is provided with scraper projections for intensifying the scraping action of the surface of the body against the interior of the rotating cylinder.

3. Apparatus for the removal of a deposit from the inner surface of a rotating cylinder having a horizontal or inclined longitudinal axis, which comprises a slidable body the cross-sectional shape of which is that of a substantially symmetrical concavo-convex silhouette having an outer side having means thereon for mating with and sliding upon the interior surface of the cylinder in a deposit-removing contact, an inner side, and two end faces, one or both of said end faces being adapted to have a swivel attached thereto.

4. The apparatus of claim 3, wherein said means comprises scraping protrusions attached to the exterior of said slidable body.

5. The apparatus of claim 4, wherein said scraping protrusions are attached to the outer side of said slidable body.

6. The apparatus of claim 4, wherein said protrusion comprises at least one of scraping, brushing, and wiping protrusions.

7. The apparatus of claim 3, wherein the means on said outer side of said slidable body are comprised of outer protruding elements and said elements are held together with said body by a central member to which said outer elements are attached.

8. The apparatus of claim 7, wherein said central part is an elongated central part having a longitudinal axis, and said outer elements are attached to said central part substantially and generally perpendicularly to its longitudinal axis.

9. The apparatus of claim 8, wherein said substantially and generally perpendicular disposition comprises disposition at an obtuse angle relative to the longitudinal axis.

10. The apparatus of claim 8, wherein said substantially and generally perpendicular disposition comprises disposition of said elements spirally about said central part.

11. The apparatus of claim 8, further comprising scraping protrusions attached to the edges of said elements.

12. The apparatus of claim 11, wherein said protrusion comprises at least one of scraping, brushing, and wiping protrusions.

13. The apparatus of claim 3, further comprising means for moving said slidable body along the longitudinal axis of the cylinder.

14. The apparatus of claim 13, wherein said means for moving comprises a rope attached by a swivel to an end face of said slidable body.

* * * * *